US011107361B1

(12) United States Patent
Songa et al.

(10) Patent No.: US 11,107,361 B1
(45) Date of Patent: Aug. 31, 2021

(54) SYSTEMS AND METHODS FOR ALERTING FOR AN INSTRUMENT LANDING SYSTEM (ILS)

(71) Applicant: HONEYWELL INTERNATIONAL INC., Morris Plains, NJ (US)

(72) Inventors: Anil Kumar Songa, Bangalore (IN); Richard Mitchel Meldrum, Glendale, AZ (US); Suresh Bazawada, Bangalore (IN); Sadguni Venkataswamy, Bangalore (IN); Dante Sadeghpour, Phoenix, AZ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 16/993,741

(22) Filed: Aug. 14, 2020

(30) Foreign Application Priority Data

Jun. 30, 2020 (IN) ..... 202011027756

(51) Int. Cl.
*G08G 5/02* (2006.01)
*G08G 5/04* (2006.01)

(52) U.S. Cl.
CPC ..... *G08G 5/025* (2013.01); *G08G 5/04* (2013.01)

(58) Field of Classification Search
CPC ..... G08G 5/025; G08G 5/04
USPC ..... 340/961
See application file for complete search history.

(56) References Cited

U.S. PATENT DOCUMENTS

| | | | | |
|---|---|---|---|---|
| 6,600,977 | B2 * | 7/2003 | Johnson | G01C 5/005 340/967 |
| 7,216,069 | B2 | 5/2007 | Heft | |
| 8,040,258 | B2 | 10/2011 | Ibrahim et al. | |
| 9,646,506 | B2 * | 5/2017 | Ishihara | G08G 5/0086 |
| 9,916,765 | B2 * | 3/2018 | Ishihara | G08G 5/0073 |
| 10,089,892 | B2 | 10/2018 | McLees et al. | |
| 10,094,682 | B2 * | 10/2018 | He | G08G 5/025 |
| 10,319,239 | B2 * | 6/2019 | Kumar | G08G 5/0013 |
| 10,472,093 | B2 | 11/2019 | Lowe et al. | |
| 2005/0015202 | A1 * | 1/2005 | Poe | G08G 5/0008 701/301 |
| 2016/0012735 | A1 * | 1/2016 | Koukol | G01S 1/14 701/17 |
| 2018/0068588 | A1 | 3/2018 | Williams | |
| 2020/0066171 | A1 * | 2/2020 | Prosser | G08G 5/0086 |

* cited by examiner

*Primary Examiner* — Kerri L McNally
(74) *Attorney, Agent, or Firm* — Lorenz & Kopf, LLP

(57) ABSTRACT

Methods and systems for instrument landing system (ILS) alerting. The method may include: receiving an ILS localizer signal and traffic information; monitoring a signal-quality of the received ILS signal; annunciating on a display system onboard the aircraft an impending ILS auto-pilot disconnect alert when the signal-quality is determined to have decreased by more than a threshold; associating the ILS signal with stored ILS antenna information to thereby construct a three-dimensional ILS envelope with a point of origination at a location of an ILS localizer; presenting a map showing the aircraft at a current location, and the runway; and, using the traffic information to monitor a location and movement of an intruder traffic and predict an infringement of the intruder traffic on the ILS envelope. Responsive to the predicted infringement, the method may annunciate an ILS alert and transmit a notification to air traffic control or the intruder traffic.

20 Claims, 6 Drawing Sheets

SYSTEMS AND METHODS FOR ALERTING FOR AN INSTRUMENT LANDING SYSTEM (ILS)

CROSS REFERENCE TO RELATED APPLICATION

This application claims priority to Indian Provisional Patent Application No. 202011027756, filed Jun. 30, 2020, the entire content of which is incorporated by reference herein.

TECHNICAL FIELD

The following disclosure relates generally to instrument landing operations, and, more particularly, to systems and methods for alerting for an instrument landing system (ILS).

BACKGROUND

Instrument landing operations rely on signals emitted from ILS antennas. ILS antennas include a localizer antenna, which is generally located beyond the departure end of the runway, and a glideslope antenna, which is generally located off to the side of the runaway, close to the approach end. In some instances, an Instrument Landing System (ILS) critical area for a runway is established. The ILS critical area may be protected by a human controller at air traffic control (ATC), generally only under specific conditions defined in an Aeronautical Information Manual (AIM). Chief among the specific conditions is when an arriving aircraft (performing an ILS landing operation) has crossed an outer marker fix or FAF, visibility being less than 2 miles, and a ceiling of less than 800 ft. The protection of this critical area is achieved by an ATC controller providing guidance, such as, to advise the pilot of an aircraft to hold short of a category two (CAT II) holding point.

However, a technical problem is presented in scenarios that do not provide protection to ILS critical areas. In one of these scenarios, the visibility is less than 2 mi, the ceiling is lower than 800 ft., and a mobile platform is performing an operation inside the outer marker fix or FAF (for example, aircraft that have landed and are exiting the runway, and aircraft that are on a missed approach or departure). In these scenarios, the ILS critical area might not be protected, and there may be no alerting or ILS guidance for the pilot. In some solutions, air traffic controllers are required to keep ILS critical areas clear of such operations when runway visual range (RVR) is 2,000 ft (600 m) or less, or the ceiling is less than 200 ft, and the arriving aircraft is inside the ILS middle marker, but this does not cover all scenarios needing ILS alerting and guidance. Additionally, at uncontrolled airports (i.e., no air traffic controllers), there is no protection of ILS critical areas and therefore no alerting. The Aeronautical Information Manual (AIM), recommends that pilots be alert when conducting a coupled approach to an uncontrolled airport, but it provides no ILS guidance for ground operations.

Accordingly, technologically improved systems and methods providing ILS alerting and guidance are desirable. A desired system provides alerting for an aircraft performing an instrument landing system (ILS) landing operation. Furthermore, other desirable features and characteristics of the present invention will be apparent from the subsequent detailed description and the appended claims, taken in conjunction with the accompanying drawings and the foregoing technical field and background.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In an embodiment, a system for alerting for an aircraft performing an instrument landing system (ILS) landing operation on a runway is provided. The system includes: a data storage of stored ILS antenna information; a source of traffic information; an on-board controller comprising a processor operationally coupled to the data storage and the source of traffic information, the controller configured by programming instructions on non-transient computer readable media to: associate an ILS signal with stored ILS antenna information to thereby construct an ILS envelope having at least two dimensions; command a display device to present a map showing the aircraft at a current location, the runway, and the ILS envelope; use the traffic information to monitor a location and movement of an intruder traffic; annunciate an ILS alert upon predicting an infringement of the intruder traffic upon the ILS envelope during the ILS landing operation; and transmit a notification to an entity other than the aircraft upon predicting the infringement of the intruder traffic upon the ILS envelope during the ILS landing operation.

Also provided is a method for alerting for an instrument landing system (ILS), the method including: at an on-board controller, receiving an ILS signal by an aircraft performing an ILS landing operation on a runway; receiving traffic information; associating the ILS signal with stored ILS antenna information to thereby construct an ILS envelope having at least two dimensions; presenting a map showing the aircraft at a current location, and the runway; using the traffic information to monitor a location and movement of an intruder traffic; annunciating an ILS alert using an onboard display device upon predicting an infringement of the intruder traffic upon the ILS envelope during the ILS landing operation; and transmitting a notification to an entity other than the aircraft upon predicting the infringement of the intruder traffic upon the ILS envelope during the ILS landing operation.

Another embodiment of a method for instrument landing system (ILS) alerting is provided. The method includes: at a controller onboard an aircraft performing an ILS landing operation on a runway, receiving an ILS localizer signal; monitoring a signal-quality of the received ILS signal; annunciating on a display system onboard the aircraft an impending ILS auto-pilot disconnect alert when the signal-quality is determined to have decreased by more than a pre-programmed percentage; associating the ILS signal with stored ILS antenna information to thereby construct a three-dimensional ILS envelope with a point of origination at a location of an ILS localizer; presenting a map showing the aircraft at a current location, and the runway; receiving traffic information; using the traffic information to monitor a location and movement of an intruder traffic and predict an infringement of the intruder traffic on the ILS envelope; annunciating, on a display within the aircraft, an ILS alert upon predicting the infringement of the intruder traffic upon the ILS envelope; transmitting a notification to air traffic control or the intruder traffic upon predicting the infringement of the intruder traffic upon the ILS envelope or of the ownship on an ILS envelope of a traffic; and annunciating, on the display within the aircraft, a second ILS alert upon receiving a notification that the ownship will infringe an ILS envelope of a traffic.

Furthermore, other desirable features and characteristics of the system and method will become apparent from the subsequent detailed description and the appended claims, taken in conjunction with the accompanying drawings and the preceding background.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. The term "exemplary," as appearing throughout this document, is synonymous with the term "example" and is utilized repeatedly below to emphasize that the description appearing in the following section merely provides multiple non-limiting examples of the invention and should not be construed to restrict the scope of the invention, as set-out in the Claims, in any respect. As further appearing herein, the term "pilot" encompasses all users of the below-described aircraft system.

As mentioned, improved ILS landing guidance and alerting that protects ILS critical areas is desirable. This is because available systems and methods may not solve all the technical problems presented in relation to ILS scenarios. For example, when the visibility is less than 2 mi, the ceiling is lower than 800 ft., and a mobile platform is performing an operation inside the outer marker fix or FAF (for example, aircraft that have landed and are exiting the runway, and aircraft that are on a missed approach or departure), the ILS critical area might not be protected and the pilot may not be alerted to this. Some existing air traffic controller solutions are limited, such as, by keeping an ILS critical area clear of such operations when runway visual range (RVR) is 2,000 ft (600 m) or less, or the ceiling is less than 200 ft, and the arriving aircraft is inside the ILS middle marker. Additionally, not all airports have air traffic controllers (uncontrolled airports) to protect any ILS critical areas or provide alerts and guidance for ILS operations. Further still, other mobile platforms, such as vehicles, can cause the technical problem of disrupting ILS signals. For example, a large grass-cutting mower operating near the localizer antenna can cause spurious and random oscillations in a signal-quality of an ILS signal, and ILS signal quality fluctuations can cause a sudden and undesirable disconnect of auto-pilot. These are just some of the technical problems presented in relation to an ILS landing operation.

The present disclosure provides a solution to the above problems in the form of systems and methods for instrument landing system (ILS) alerting for aircraft. The provided systems and methods do not rely on air traffic control to supply a pilot with alerts for the ILS landing operation.

Figure 1:
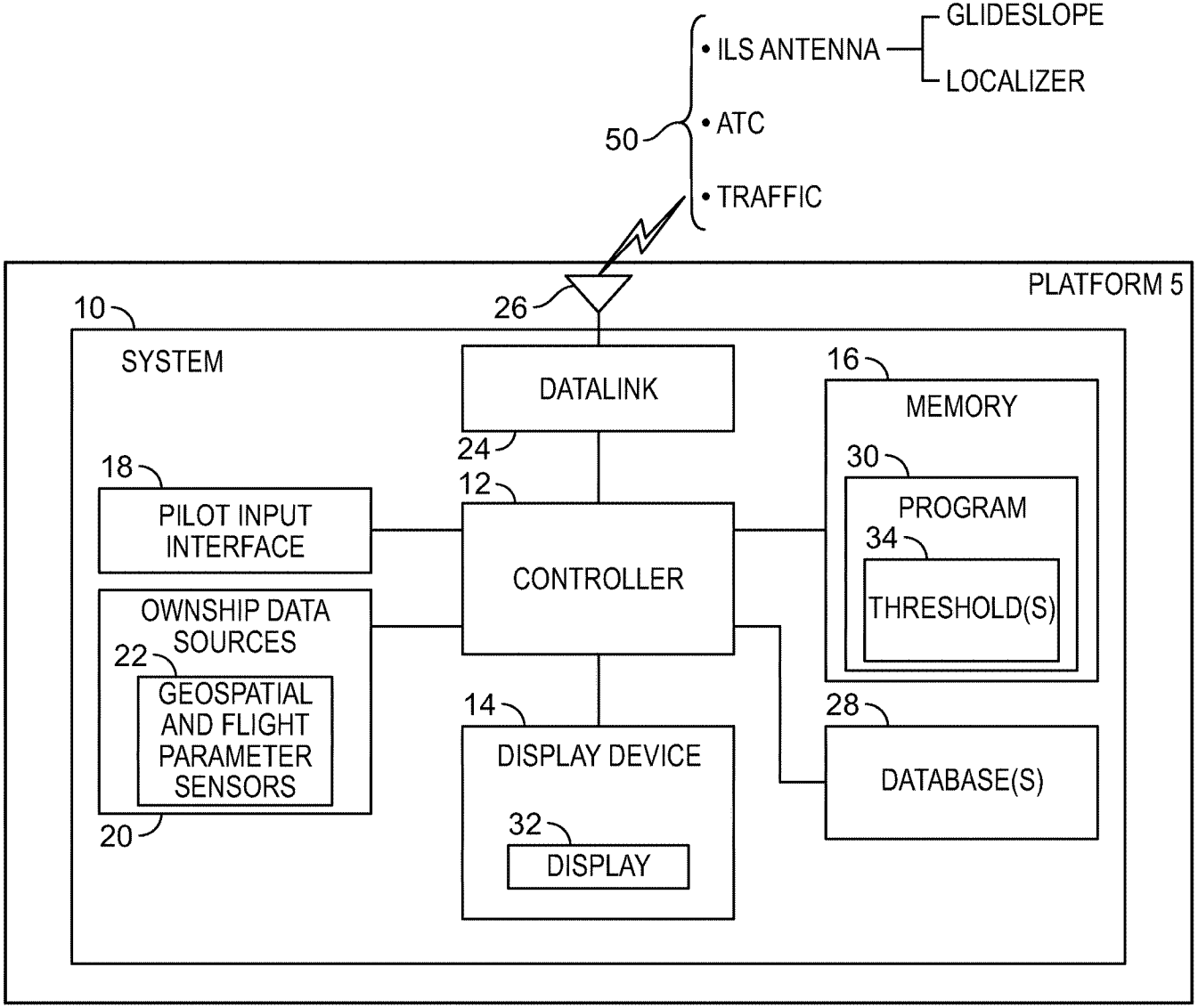
FIG. 1 is a block diagram of a system for instrument landing system (ILS) alerting for an aircraft, as illustrated in accordance with an exemplary embodiment of the present disclosure.

FIG. 1 is a block diagram of a system 10 for instrument landing system (ILS) alerting for an aircraft, as illustrated in accordance with an exemplary and non-limiting embodiment of the present disclosure. The system 10 for ILS alerting for an aircraft may be utilized onboard a mobile platform 5 to provide enhanced ILS alerting, as described herein. In various embodiments, the mobile platform is an aircraft 5, which carries or is equipped with the system 10 for an instrument landing system (ILS) landing operation. As schematically depicted in FIG. 1, system 10 for an instrument landing system (ILS) alerting for an aircraft (shortened herein to "system" 10) includes the following components or subsystems, each of which may assume the form of a single device or multiple interconnected devices: a controller 12 operationally coupled to: at least one display device 14; computer-readable storage media or memory 16; an optional input interface 18, and ownship data sources 20 including, for example, an array of flight system status and geospatial sensors 22. The system 10 may be separate from or integrated within: a flight management system (FMS) and/or a flight control system (FCS). The system 10 may also contain a datalink subsystem 24 including an antenna 26, which may wirelessly transmit data to and receive real-time data and signals from various external sources (50), including, each of: traffic, air traffic control (ATC), ILS antennas (glide slope and localizer), ground stations, and the like.

It may be appreciated that the external source 50 "traffic" may include, but is not limited to, aircraft, drones, urban air mobility vehicles, and ground vehicles. When a traffic is predicted to infringe, or is infringing, upon an ILS envelope constructed by the system 10, it may be referred to herein as an intruder traffic. The system 10 may use various position monitoring systems for monitoring a position and movement of respective traffic, including traffic collision avoidance (TCAS), automatic dependent surveillance broadcast (ADSB), and enhanced vision systems (EVS).

Although schematically illustrated in FIG. 1 as a single unit, the individual elements and components of the system 10 can be implemented in a distributed manner utilizing any practical number of physically distinct and operatively interconnected pieces of hardware or equipment. When the system 10 is utilized as described herein, the various components of the system 10 will typically all be located onboard the Aircraft 5.

The term "controller," as appearing herein, broadly encompasses those components utilized to carry-out or otherwise support the processing functionalities of the system 10. Accordingly, controller 12 can encompass or may be associated with a programmable logic array, application specific integrated circuit or other similar firmware, as well as any number of individual processors, flight control computers, navigational equipment pieces, computer-readable memories (including or in addition to memory 16), power supplies, storage devices, interface cards, and other standardized components. In various embodiments, controller 12 embodies one or more processors operationally coupled to data storage having stored therein at least one firmware or software program (generally, computer-readable instructions that embody an algorithm) for carrying-out the various process tasks, calculations, and control/display functions described herein. During operation, the controller 12 may be programmed with and execute the at least one firmware or software program, for example, program 30, that embodies an algorithm for receiving, processing, and displaying, ILS alerting for an aircraft 5, to thereby perform the various process steps, tasks, calculations, and control/display functions described herein.

Controller 12 may exchange data, including real-time wireless data, with one or more external sources 50 to support operation of the system 10 in embodiments. In this case, bidirectional wireless data exchange may occur over a communications network, such as a public or private network implemented in accordance with Transmission Control Protocol/Internet Protocol architectures or other conventional protocol standards. Encryption and mutual authentication techniques may be applied, as appropriate, to ensure data security.

Memory 16 is a data storage that can encompass any number and type of storage media suitable for storing computer-readable code or instructions, such as the aforementioned software program 30, as well as other data generally supporting the operation of the system 10. Memory 16 may also store one or more threshold 34 values, for use by an algorithm embodied in software program 30. Examples of threshold 34 values include a pre-programmed percentage, such as 20%, that is used for monitoring signal-quality. One or more database(s) 28 are another form of storage media; they may be integrated with memory 16 or separate from it.

In various embodiments, aircraft-specific parameters and information for aircraft 5 may be stored in the memory 16 or in a database 28 and referenced by the program 30. Non-limiting examples of aircraft-specific information includes an aircraft weight and dimensions, performance capabilities, configuration options, and the like.

In various embodiments, two- or three-dimensional map data may be stored in a database 28, including airport features data, geographical (terrain), buildings, bridges, and other structures, street maps, and navigational databases, which may be updated on a periodic or iterative basis to ensure data timeliness. This map data may be uploaded into the database 28 at an initialization step and then periodically updated, as directed by either a program 30 update or by an externally triggered update.

Flight parameter sensors and geospatial sensors 22 supply various types of data or measurements to controller 12 during Aircraft flight. In various embodiments, the geospatial sensors 22 supply, without limitation, one or more of: inertial reference system measurements providing a location, Flight Path Angle (FPA) measurements, airspeed data, groundspeed data (including groundspeed direction), vertical speed data, vertical acceleration data, altitude data, attitude data including pitch data and roll measurements, yaw data, heading information, sensed atmospheric conditions data (including wind speed and direction data), flight path data, flight track data, radar altitude data, and geometric altitude data.

In certain embodiments of system 10, the controller 12 and the other components of the system 10 may be integrated within or cooperate with any number and type of systems commonly deployed onboard an aircraft including, for example, an FMS, an Attitude Heading Reference System (AHRS), an Instrument Landing System (ILS), and/or an Inertial Reference System (IRS).

With continued reference to FIG. 1, display device 14 can include any number and type of image generating devices on which one or more avionic displays 32 may be produced. When the system 10 is utilized for a manned Aircraft, display device 14 may be affixed to the static structure of the Aircraft cockpit as, for example, a Head Down Display (HDD) or Head Up Display (HUD) unit. Alternatively, display device 14 may assume the form of a movable display device (e.g., a pilot-worn display device) or a portable display device, such as an Electronic Flight Bag (EFB), a laptop, or a tablet computer carried into the Aircraft cockpit by a pilot.

At least one avionic display 32 is generated on display device 14 during operation of the system 10; the term "avionic display" defined as synonymous with the term "aircraft-related display" and "cockpit display" and encompasses displays generated in textual, graphical, cartographical, and other formats. The system 10 can generate various types of lateral and vertical avionic displays 32 on which map views and symbology, text annunciations, and other graphics pertaining to flight planning are presented for a pilot to view. The display device 14 is configured to continuously render at least a lateral display 32 showing the Aircraft 5 at its current location within the map data. The avionic display 32 generated and controlled by the system 10 can include graphical user interface (GUI) objects and alphanumerical input displays of the type commonly presented on the screens of MCDUs, as well as Control Display Units (CDUs) generally. Specifically, embodiments of avionic displays 32 include one or more two dimensional (2D) avionic displays, such as a horizontal (i.e., lateral) navigation display or vertical navigation display; and/or on one or more three dimensional (3D) avionic displays, such as a Primary Flight Display (PFD) or an exocentric 3D avionic display.

In various embodiments, a human-machine interface, such as the above described touch screen display, is implemented as an integration of the pilot input interface 18 and a display device 14. Via various display and graphics systems processes, the controller 12 may command and control the touch screen display generating a variety of graphical user interface (GUI) objects or elements described herein, including, for example, buttons, sliders, and the like, which are used to prompt a user to interact with the human-machine interface to provide user input, and to activate respective functions and provide user feedback, responsive to received user input at the GUI element.

Figure 2:
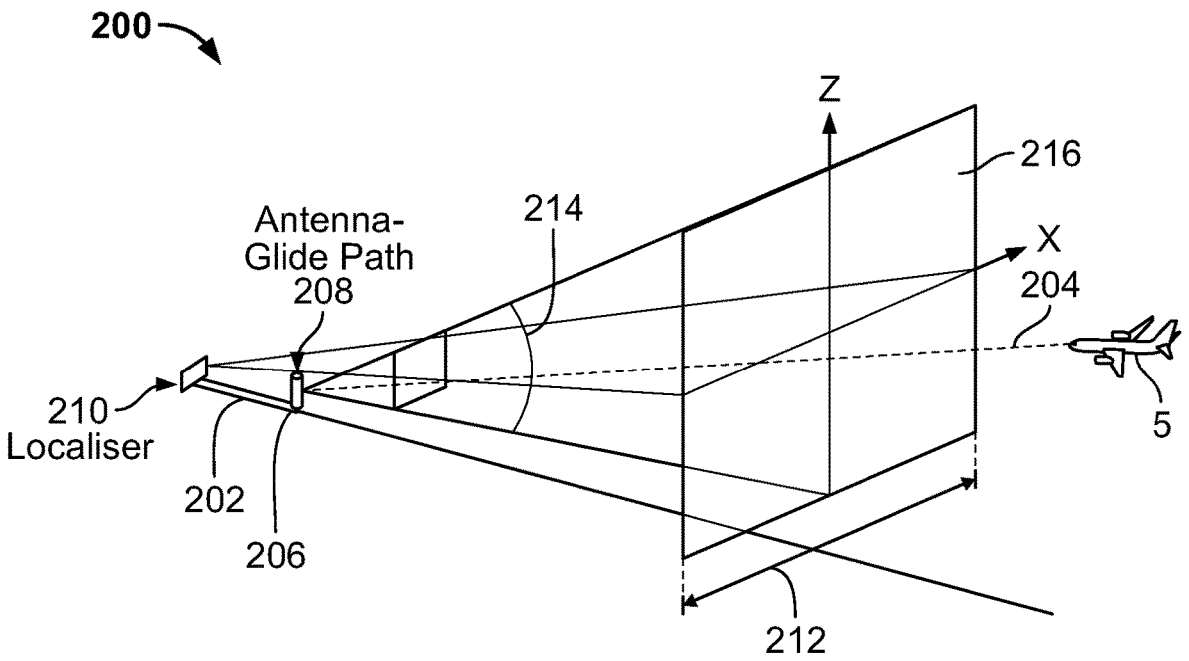
FIG. 2 (Prior Art)
FIGS. 2-4 illustrate construction of an ILS envelope on which to trigger alerts, in accordance with an exemplary embodiment of the present disclosure.

Some background information for ILS landing operations is provided with FIG. 2. The aircraft 5 is performing an ILS landing operation to land on runway 202. The aircraft 5 is on a trajectory 204 from its current location to an aiming point on a runway threshold 206 of the runway 202. The ILS antenna, when present, transmits an ILS signal that the aircraft 5 may receive and process in the course of performing the ILS landing operation. As used herein, an ILS antenna can be a glide path antenna 208 or a localizer antenna 210. The glide path antenna 208 signal includes a glide path angle 214 measured in the Z axis, from sea level upward, providing vertical guidance or constraints for the aircraft 5. The localizer antenna 210 signal, when present, includes lateral (i.e., horizontal) guidance 212 or constraints for the aircraft 5. When both are present, the glide path angle 214 from glide path antenna 208 and localizer guidance from localizer antenna 210 may bisect each other and may be used to create a guidance rectangle in the Z axis. One may move the guidance rectangle 216 in a region of space between the runway threshold 206 and a current location of the aircraft 5, along the flight path; in this region, the rectangle may change size, becoming larger closer to an aircraft current position.

Figure 3:
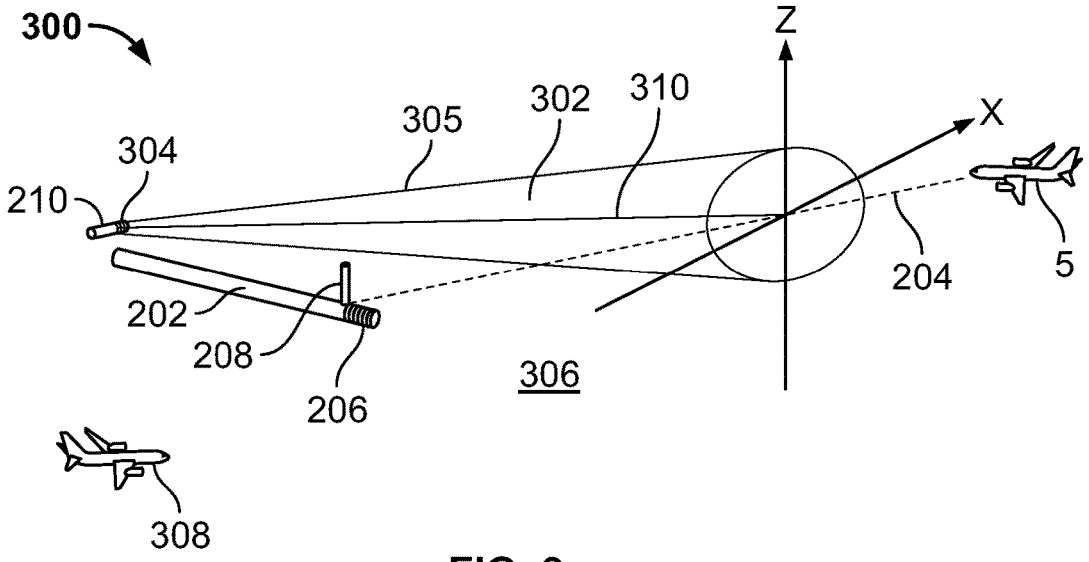
Figure 4:
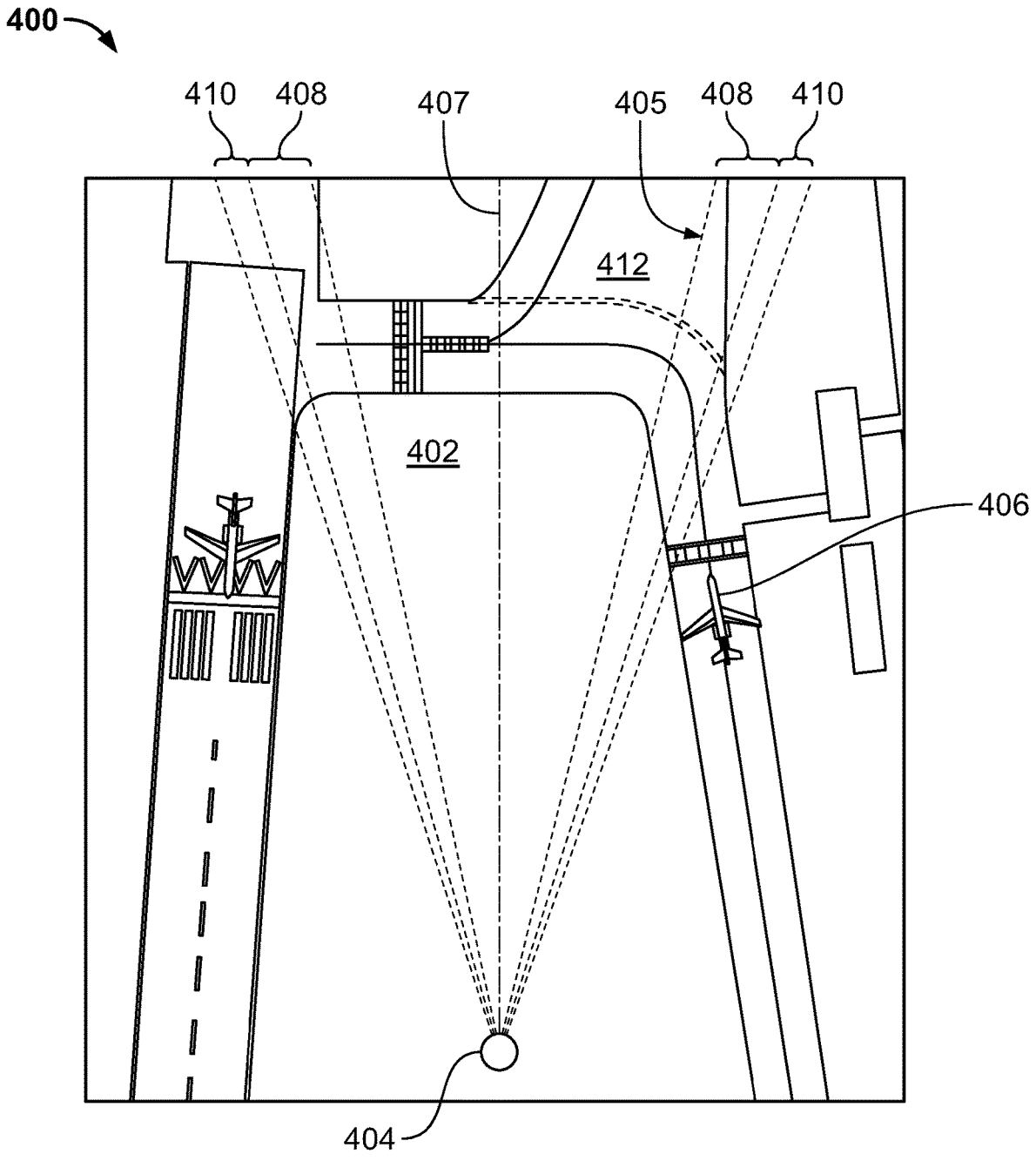
Figure 5:
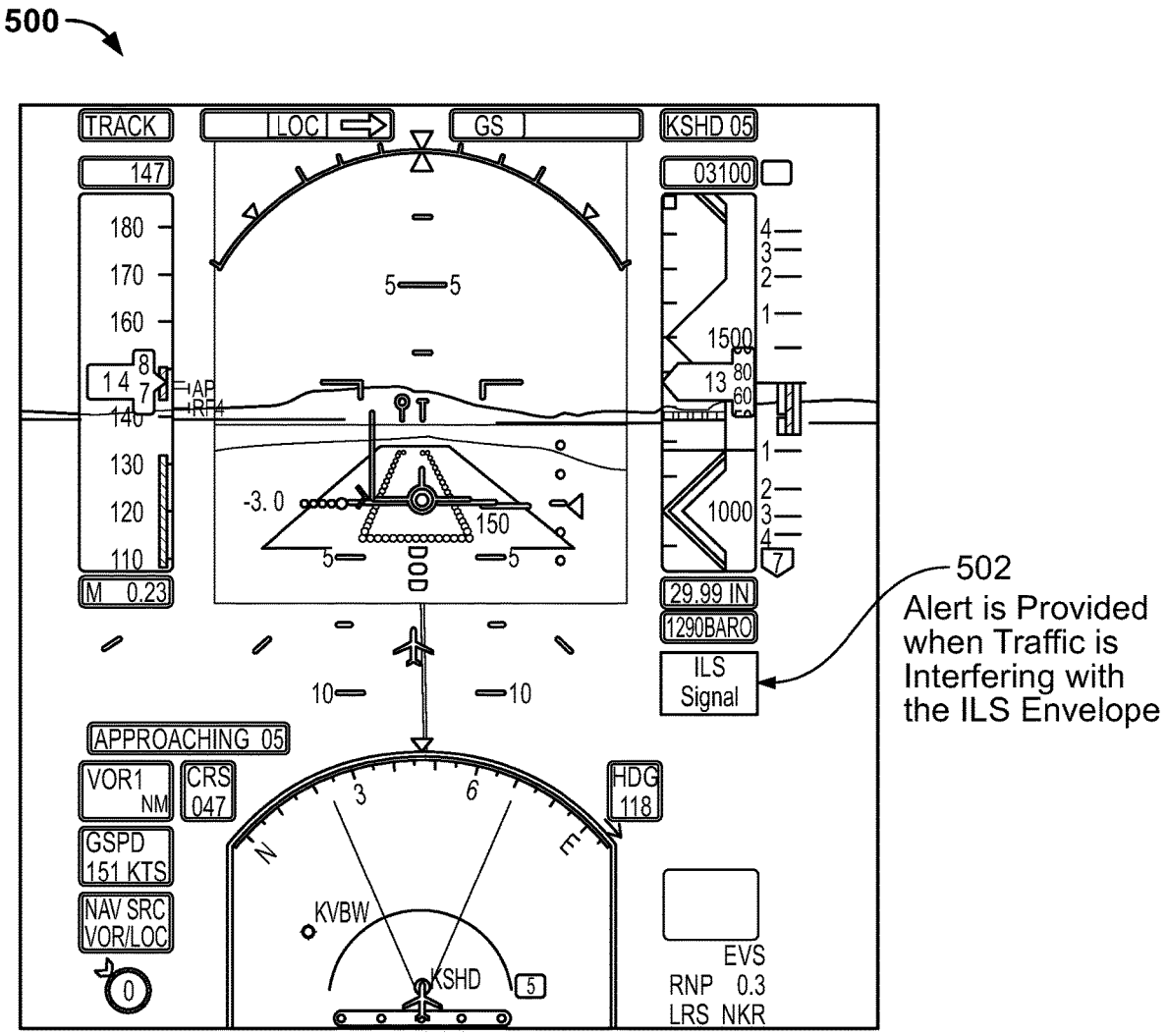
FIGS. 5-7 depict various ways that an ILS alert may be annunciated, in accordance with an exemplary embodiment of the present disclosure.

Turning now to FIGS. 3-5, some technical improvements to ILS guidance of FIG. 2 that the system 10 provides are described. As shown in FIGS. 3-4, in various embodiments, the system 10 constructs a two- or three-dimensional ILS envelope 302 (FIG. 4, 402) having a regular shape along an axis 310 (FIG. 4, 407), the ILS envelope 302 has a point of origination 304 (FIG. 4, 404).

The controller 12 is operationally coupled to the data storage of stored ILS antenna information and to an external source 50 of traffic information. In various embodiments, the database(s) 28 stores the ILS antenna information. In some embodiments, the memory 16 may store the ILS antenna information. The controller 12 executes programming instructions (for example, program 36) stored on non-transient computer readable media (for example memory 16) to perform its functions. In an embodiment, the controller 12 constructs the ILS envelope by: receiving an ILS signal from the external source 50 and associating it with respective antenna information stored on-board in the data storage. In another embodiment, the controller 12 construct the ILS envelope based on a known antenna location and the respective antenna information stored on-board in the data storage.

In a first aspect, the antenna information includes the geospatial location of the ILS antenna, bearing of the ILS antenna, and the type of the ILS antenna, which is relevant because, from runway to runway, a location of one or more respective ILS antennas is not always the same. The ILS antenna information allows the controller 12 to determine where the ILS antenna is located and how it is spatially directed. In a second aspect, not every ILS signal has the same features, such as, strength and contents. Putting these two aspects together, it may be appreciated that each runway can have a unique combination of ILS signal and ILS antenna information. Accordingly, the controller 12 constructs a unique ILS envelope for each respective runway based on associating an ILS signal with stored ILS antenna information.

The point of origination 304 is described as a point from which the ILS envelope 302 (FIG. 4, 402) expands in regular cross-sectional area, when moving along an axis 310 (FIG. 4, 407) from the point of origination 304 outward (e.g., moving to the right in FIG. 3, and moving to the top of the page in FIG. 4). The ILS envelope 302 has boundary 305 (FIG. 4, 405). In various embodiments, the regular shape created by the ILS envelope 302 is a cone in three-dimensions or triangle in two-dimensions. In various embodiments, as shown in FIG. 3, the point of origination may be the ILS localizer antenna 210 location. In FIG. 3, it is understood that although the remainder of the image 300 is empty for simplification purposes, in practice, area 306 may be populated with various airport features.

In various embodiments, the controller 12 may command the display device 14 to present a map showing the aircraft 5 at a current location, the runway 202, and the ILS envelope 302, as depicted in FIG. 3. In other embodiments, the controller 12 may command the display device 14 to present a map showing airport features and the ILS envelope 302. In other embodiments, as depicted in FIG. 4, the controller 12 may command the display device to present a map 400 showing airport features, traffic 406, and the ILS envelope 402.

The controller 12 displays the ILS envelope on a lateral display or a vertical display. In various embodiments, the controller 12 displays the ILS envelope on a PFD in a perspective view. As may be appreciated, a variety of visualization techniques may be used by the controller 12 to visually distinguish the ILS envelope 302. In an example, the ILS envelope 302 may be rendered in a distinct color, such as a slightly transparent highlighter yellow. Regardless of the visualization technique used, the display of the ILS envelope 302 is sufficiently transparent to not obscure features (FIG. 4, 412) that may be within the ILS envelope. In various embodiments, the boundary 305 (FIG. 4, 405) may be rendered distinctly from the ILS envelope, such as, with a border line or dashed line.

The controller 12 also receives traffic information from an external source 50. The traffic information for each traffic may be monitored to determine a location and movement or trajectory of the traffic. As used herein, an intruder traffic is identified as a traffic that might infringe on the ILS envelope (meaning that it is imminent), or already has infringed on the ILS envelope (meaning that it is within the ILS envelope). The controller 12 processes the traffic data to predict an infringement of an intruder traffic (FIG. 3, 308 and FIG. 4 406). Upon predicting an infringement of the intruder traffic upon the ILS envelope during the ILS landing operation, the controller 12 annunciates an ILS alert. In various embodiments, the ILS alert may be aurally, haptically, and/or visually annunciated. In an embodiment, upon predicting an infringement of the intruder traffic 406 upon the ILS envelope 402 during the ILS landing operation, the controller 12 modifies the boundary 405 of the ILS envelope 402. In an embodiment, upon predicting an infringement of the intruder traffic 406 upon the ILS envelope 402 during the ILS landing operation, the controller 12 modifies the visualization technique to indicate the predicted infringement of the intruder traffic (e.g., by changing a display color of the ILS envelope 402). In various embodiments, upon predicting an infringement of the intruder traffic 406 upon the ILS envelope 402 during the ILS landing operation, the controller 12 transmits a notification to an entity other than the aircraft 5. In some embodiments, the entity other than the aircraft 5 is air traffic control (ATC). In some embodiments, the entity other than the aircraft 5 is the intruder traffic 406. Non-limiting examples of intruder traffic include an airplane, a rotorcraft, a drone, an urban air mobility vehicle, and a ground vehicle.

Figure 6:
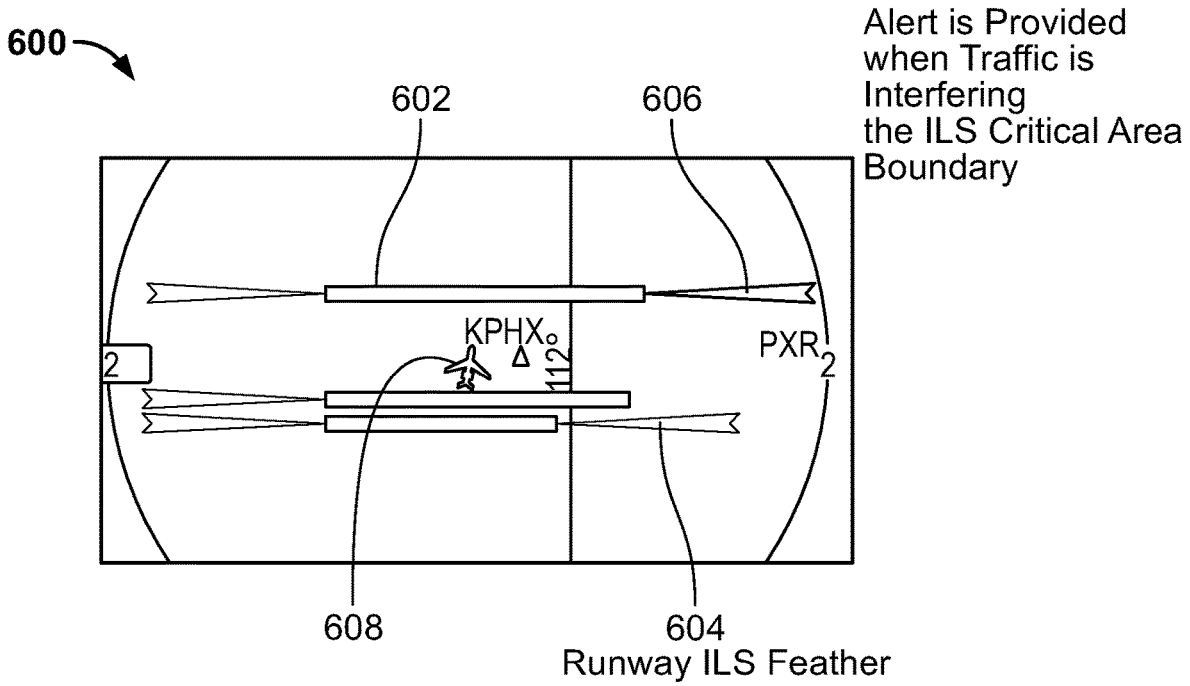
Figure 7:
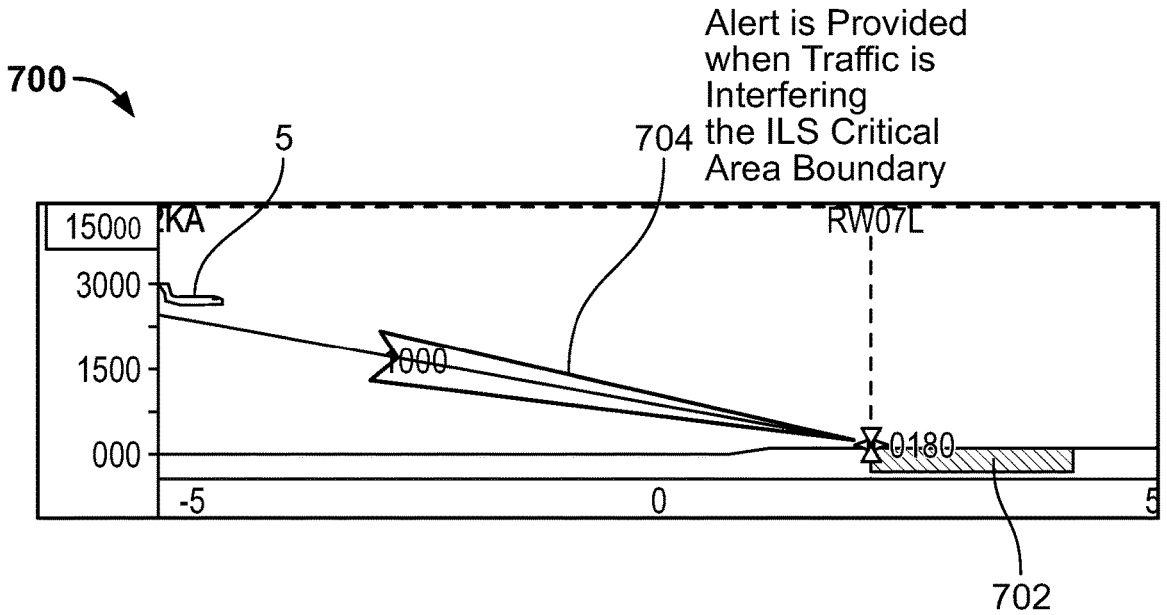

With respect to FIG. 5, in various embodiments, the controller 12 is further programmed to annunciate the ILS alert by rendering an alphanumeric message 502 on a primary flight display (PFD) 500. In the example of FIG. 5, the alphanumeric message states "ILS signal," but other alphanumeric messages may be employed to convey the alert on the PFD 500. Annunciating an ILS alert upon predicting an infringement of the intruder traffic upon the ILS envelope during the ILS landing operation can also be shown on a lateral/navigation map or on a vertical situation display, as shown in FIGS. 6-7. On lateral map 600, a runway ILS feather 604 may be rendered at each runway that has support for an ILS landing operation. The system 10 may change the visual presentation of the runway ILS feather, such as, by highlighting it or by rendering it with a dashed outline, as shown with runway feather 606, to alert a pilot performing an ILS landing operation on runway 602 that intruder traffic 608 is interfering with the ILS envelope that the system 10 has constructed. Intruder traffic can be depicted on a vertical situation display or a lateral display or a PFD. In FIG. 7, vertical situation display 700 depicts the aircraft 5 on a trajectory to land at runway 702. The system 10 may render a visually distinguished ILS feather 704 to alert a pilot performing an ILS landing operation on runway 702 that an intruder traffic is determined to be interfering with the ILS envelope that the system 10 has constructed.

As mentioned, the controller 12 may monitor a signal-quality, such as signal strength, over time, of the received ILS signal. The controller 12 may compare deviations in the signal-quality to a pre-programmed threshold or percentage. Sometimes an autopilot system on the aircraft 5 will disconnect when the signal-quality of the ILS signal decays too much. Therefore, in various embodiments, the system 10 advantageously may determine when the signal-quality has decreased by more than the pre-programmed percentage; this enables the system 10 to determine if and when auto-pilot may be disconnected, and to annunciate an impending ILS auto-pilot disconnect alert responsive thereto. The impending ILS auto-pilot disconnect alert may be rendered as an alphanumeric message on a PFD or other display. In an embodiment, the pre-programmed percentage is 20%. Thus, the system 10 provides enhanced ILS guidance with alerting based on locations of ILS antennas and signal quality or strength.

In addition to the above enhanced ILS guidance provided by the system 10, a user may wish to pre-program one or more respective alerting levels based on a time/distance before either the intruder traffic, or the ownship aircraft, interferes with an existing ILS envelope. To provide these features, the system 10 may construct one or more buffers around the ILS envelope, and assign the one or more buffers respective alerting levels based on a time/distance before either the intruder traffic, or the ownship aircraft, interferes the ILS envelope. With focus again on the ILS envelope 402 shown in FIG. 4, in an embodiment, the controller 12 may surround the ILS envelope 402 in one or more configurable buffer zones, as follows. The ILS envelope 402 may be buffered within a first zone, indicated by area 408; this first zone may represent a pre-programmed warning closure time before the intruder traffic or the ownship traffic infringes on the ILS envelope 402. In various embodiments, the first zone may then be buffered within a second zone, indicated by area 410; this second zone may a pre-programmed caution closure time before the intruder traffic or the ownship traffic infringes on the ILS envelope 402.

With these two additional buffers around the ILS envelope, the controller 12 can provide additional levels of sophistication to the human-machine interface for ILS alerting during a landing operation: it can generate a warning closure time alert responsive to determining that the intruder traffic or ownship aircraft will infringe upon the first zone during the ILS landing operation; and it can generate a caution closure time alert responsive to determining that the intruder traffic or ownship aircraft will infringe upon the second zone during the ILS landing operation. In an embodiment, the pre-programmed warning closure time can be about 10 seconds and the pre-programmed caution closure time can be about 20 seconds. As used herein, "about" is plus or minus 5%. The first zone and the second zone, when displayed, are rendered in a visually distinguishable manner, and are also sufficiently transparent to not obscure airport features. As described above, the alerts generated by these two additional buffers may be displayed onboard an ownship aircraft performing the landing operation, or they can be transmitted externally, to the intruder traffic itself, or to a ground station or air traffic control.

In various embodiments, the system 10 may generate and display the ILS envelope, the first zone, and the second zone, on a lateral display and/or a vertical display and/or a PFD in perspective view, responsive to user input selections. In other embodiments, the system 10 may be configured to default to display the ILS envelope, the ILS envelope and the first zone, or the ILS envelope and the first zone and the second zone, and then be responsive to user input that modifies each of them. User input may be used to determine which of: a lateral display, a vertical display, and a synthetic vision display, is used for conveying the alerting to the pilot (e.g., FIG. 4, FIG. 5, FIG. 6, and FIG. 7).

Naturally, in some scenarios, the ownship aircraft 5 will be the intruding and infringing aircraft on an ILS envelope to be used by another traffic aircraft for an ILS landing operation. In these scenarios, the ownship aircraft receives a notification from the traffic that it may interfere with an ILS envelope for the traffic. Upon receiving such a notification, the system 10 on the ownship aircraft annunciates a second ILS alert on any combination of a lateral display, a vertical display, and a synthetic vision PFD.

Figure 8:
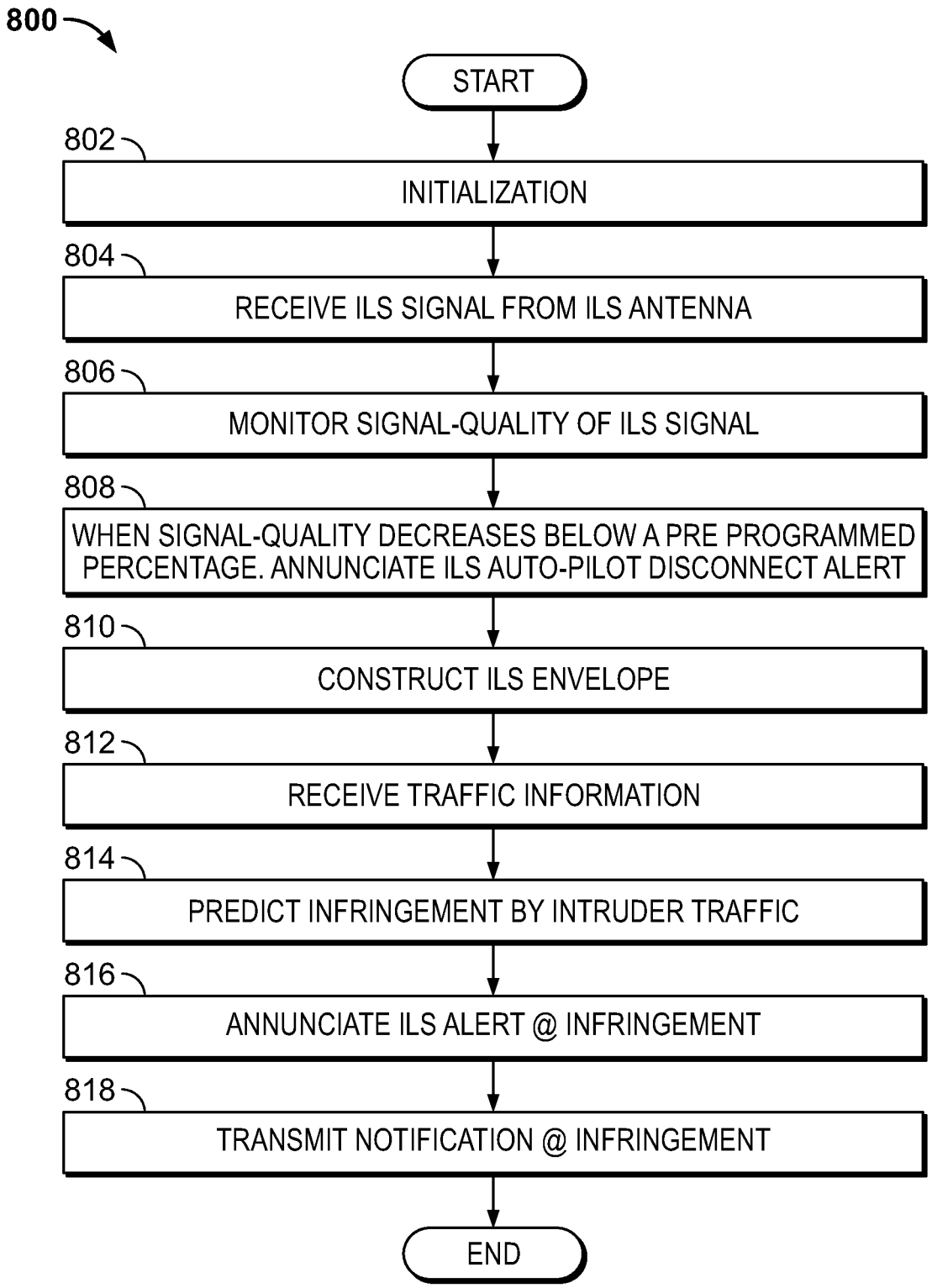
FIG. 8 is a flow chart of a method for alerting for instrument landing system (ILS) landing operations, as may be implemented by the system of FIG. 1, in accordance with an exemplary embodiment of the present disclosure.

Turning now to FIG. 8, the system 10 described above may be implemented by a processor-executable method 800 providing alerting for an aircraft 5 performing an instrument landing system (ILS) landing operation on a runway. For illustrative purposes, the following description of method 800 may refer to elements mentioned above in connection with FIG. 1. In practice, portions of method 800 may be performed by different components of the described system. It should be appreciated that method 800 may include any number of additional or alternative tasks, the tasks shown in FIG. 8 need not be performed in the illustrated order, and method 800 may be incorporated into a more comprehensive procedure or method having additional functionality not described in detail herein. Moreover, one or more of the tasks shown in FIG. 8 could be omitted from an embodiment of the method 800 as long as the intended overall functionality remains intact.

At 802, the system 10 is initialized. Initialization may include loading instructions and program 30 into a processor within the controller 12, as well as loading ILS antenna information, map data, and aircraft-specific features into one or more database(s) 28. At 804 the method is receiving an ILS localizer signal. As mentioned, this may be a localizer antenna signal or a glideslope antenna signal or both. At 806 the method may monitor a signal-quality, such as the signal strength, of the received ILS signal, At 808, when the signal-quality is determined to have decreased by more than a pre-programmed percentage or threshold, the method may annunciate on an onboard display device 14 onboard the aircraft an impending ILS auto-pilot disconnect alert. At 810, the method may construct the ILS envelope. It may be two- or three-dimensional. The method may associate the received ILS signal with stored ILS antenna information to thereby construct the ILS envelope. At 812, the method may receive traffic information from any of aircraft, land vehicles, drones, and the like. At 814, the method predicts an infringement by an intruder traffic. At 816, responsive to detecting the infringement, an ILS alert is annunciated on the onboard display device 14. In various embodiments, annunciating the ILS alert at 816 includes presenting a map showing the aircraft at a current location, and the runway. In some embodiments, annunciating the ILS alert at 816 includes providing an alphanumeric message on a PFD. At 818, responsive to detecting the infringement, a notification about the predicted infringement is transmitted to an entity other than the ownship aircraft. After 818 the method 800 may end or return to 804.

Thus, enhanced systems and methods for alerting for an instrument landing system (ILS) are provided. The provided methods and systems provide an objectively improved human-machine interface with map views, alerting, and notifications that provide relevant and time-critical information. The provided enhanced features do not rely on ATC input to determine the ILS envelope. The provided enhanced features provide a user with increased confidence about the surroundings during an ILS landing operation.

Although an exemplary embodiment of the present disclosure has been described above in the context of a fully-functioning computer system (e.g., system 10 described above in conjunction with FIG. 1), those skilled in the art will recognize that the mechanisms of the present disclosure are capable of being distributed as a program product (e.g., an Internet-disseminated program or software application) and, further, that the present teachings apply to the program product regardless of the particular type of computer-readable media (e.g., hard drive, memory card, optical disc, etc.) employed to carry-out its distribution.

Terms such as "comprise," "include," "have," and variations thereof are utilized herein to denote non-exclusive inclusions. Such terms may thus be utilized in describing processes, articles, apparatuses, and the like that include one or more named steps or elements but may further include additional unnamed steps or elements. While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. Various changes may be made in the function and arrangement of elements described in an exemplary embodiment without departing from the scope of the invention as set-forth in the appended Claims.

What is claimed is:

1. A system for alerting for an aircraft performing an instrument landing system (ILS) landing operation on a runway, the system comprising:

a data storage of stored ILS antenna information;

a source of traffic information;

an on-board controller comprising a processor operationally coupled to the data storage and the source of traffic information, the controller configured by programming instructions on non-transient computer readable media to:

associate an ILS signal with stored ILS antenna information to thereby construct an ILS envelope having at least two dimensions;

command a display device to present a map showing the aircraft at a current location, the runway, and the ILS envelope;

use the traffic information to monitor a location and movement of an intruder traffic;

annunciate an ILS alert upon predicting an infringement of the intruder traffic upon the ILS envelope during the ILS landing operation; and transmit a notification to an entity other than the aircraft upon predicting the infringement of the intruder traffic upon the ILS envelope during the ILS landing operation.

2. The system of claim 1, wherein the on-board controller is integrated with a flight management system (FMS) of the aircraft.

3. The system of claim 1, wherein the ILS signal is from an ILS antenna, and wherein the stored ILS antenna information includes, for the ILS antenna: an ILS localizer location and bearing, a glide slope antenna position and bearing, or an ILS localizer location/bearing and a glide slope antenna position/bearing.

4. The system of claim 3, wherein the ILS envelope is cone shaped and the controller is further programmed to:

render the ILS envelope using a visualization technique on a lateral display or vertical display; and modify a boundary of the ILS envelope or the visualization technique to indicate the predicted infringement of the intruder traffic.

5. The system of claim 4, wherein the ILS envelope has a point of origination at the ILS localizer antenna location.

6. The system of claim 3, wherein the controller is further programmed to annunciate the ILS alert by rendering an alphanumeric message on a primary flight display.

7. The system of claim 3, wherein the ILS envelope is three dimensional.

8. The system of claim 3, wherein the controller is further configured to:

monitor a signal-quality of the received ILS signal; and annunciate an impending ILS auto-pilot disconnect alert when the signal-quality is determined to have decreased by more than a pre-programmed percentage.

9. The system of claim 8, wherein the pre-programmed percentage is 20%.

10. The system of claim 1, wherein the entity other than the aircraft is an air traffic control center or ground station.

11. The system of claim 1, wherein the entity other than the aircraft is the intruder traffic.

12. The system of claim 1, wherein the source of traffic information is at least one of:

ADSB, TCAS, and EVS.

13. The system of claim 1, wherein the intruder traffic is one of: a drone, urban air mobility vehicle, and a ground vehicle.

14. The system of claim 1, wherein the controller is further configured to:

buffer the ILS envelope within a first zone representing a pre-programmed warning closure time; and generate a warning closure time alert responsive to determining that the intruder traffic or aircraft will infringe upon the first zone during the ILS landing operation; and buffer the first zone within a second zone representing a pre-programmed caution closure time; and generate a caution closure time alert responsive to determining that the intruder traffic or aircraft will infringe upon the second zone during the ILS landing operation.

15. The system of claim 14, wherein the pre-programmed warning closure time is about 10 seconds and the pre-programmed caution closure time is about 20 seconds.

16. A method for alerting for an instrument landing system (ILS), the method comprising:

at an on-board controller receiving an ILS signal by an aircraft performing an ILS landing operation on a runway;

receiving traffic information;

associating the ILS signal with stored ILS antenna information to thereby construct an ILS envelope having at least two dimensions;

presenting a map showing the aircraft at a current location, and the runway;

using the traffic information to monitor a location and movement of an intruder traffic;

annunciating an ILS alert using an onboard display device upon predicting an infringement of the intruder traffic upon the ILS envelope during the ILS landing operation; and transmitting a notification to an entity other than the aircraft upon predicting the infringement of the intruder traffic upon the ILS envelope during the ILS landing operation.

17. The method of claim 16, wherein the ILS envelope is cone shaped, has a point of origination at the ILS localizer antenna location, and further comprising:

rendering the ILS envelope on the map using a visualization technique on a lateral display or vertical display; and modifying a boundary of the ILS envelope or the visualization technique to indicate the predicted infringement of the intruder traffic.

18. The method of claim 17, further comprising:

monitoring a signal-quality of the received ILS signal; and annunciating an impending ILS auto-pilot disconnect alert when the signal-quality is determined to have decreased by more than a pre-programmed percentage.

19. The method of claim 18, further comprising:

buffering the ILS envelope within a first zone representing a pre-programmed warning closure time; and generating a warning closure time alert responsive to determining that the intruder traffic or aircraft will infringe upon the first zone during the ILS landing operation; and buffering the first zone within a second zone representing a pre-programmed caution closure time; and generating a caution closure time alert responsive to determining that the intruder traffic or aircraft will infringe upon the second zone during the ILS landing operation.

20. A method for instrument landing system (ILS) alerting, the method comprising:

at a controller onboard an aircraft performing an ILS landing operation on a runway, receiving an ILS localizer signal;

monitoring a signal-quality of the received ILS signal;

annunciating on a display system onboard the aircraft an impending ILS auto-pilot disconnect alert when the signal-quality is determined to have decreased by more than a pre-programmed percentage;

associating the ILS signal with stored ILS antenna information to thereby construct a three-dimensional ILS envelope with a point of origination at a location of an ILS localizer;

presenting a map showing the aircraft at a current location, and the runway;

receiving traffic information;

using the traffic information to monitor a location and movement of an intruder traffic and predict an infringement of the intruder traffic on the ILS envelope;

annunciating, on a display within the aircraft, an ILS alert upon predicting the infringement of the intruder traffic upon the ILS envelope;

transmitting a notification to air traffic control or the intruder traffic upon predicting the infringement of the intruder traffic upon the ILS envelope or of the ownship on an ILS envelope of a traffic; and annunciating, on the display within the aircraft, a second ILS alert upon receiving a notification that the ownship will infringe an ILS envelope of a traffic.

* * * * *